US007896172B1

(12) United States Patent
Hester

(10) Patent No.: US 7,896,172 B1
(45) Date of Patent: Mar. 1, 2011

(54) COMPACTABLE PRODUCT PUSHER SYSTEM AND DISPLAY

(76) Inventor: Thomas F. Hester, Ventura, CA (US)

( * ) Notice: Subject to any disclaimer, the term of this patent is extended or adjusted under 35 U.S.C. 154(b) by 827 days.

(21) Appl. No.: 11/700,963

(22) Filed: Jan. 31, 2007

Related U.S. Application Data

(60) Provisional application No. 60/764,100, filed on Jan. 31, 2006.

(51) Int. Cl.
*A47F 1/04* (2006.01)

(52) U.S. Cl. ..... 211/59.3; 211/51; 211/85; 221/279

(58) Field of Classification Search ..... 211/51, 211/59.3, 72, 85, 195; 206/756, 759, 761, 206/85; 221/279, 305, 51, 52, 56, 58, 59; 312/61, 76, 86
See application file for complete search history.

(56) References Cited

U.S. PATENT DOCUMENTS

| | | | | | |
|---|---|---|---|---|---|
| 1,682,580 | A * | 8/1928 | Pratt | 221/51 |
| 2,185,605 | A * | 1/1940 | Murphy et al. | 206/252 |
| 2,331,035 | A * | 10/1943 | Lundstrom | 206/252 |
| 2,538,165 | A | 1/1951 | Randtke | 129/26 |
| 3,166,195 | A | 1/1965 | Taber | 211/49 |
| 3,300,166 | A | 1/1967 | Wojciechowski | 248/174 |
| 3,433,546 | A | 3/1969 | Cohen | 312/71 |
| 3,606,082 | A * | 9/1971 | Kuchenbecker | 221/52 |
| 3,767,083 | A * | 10/1973 | Webb | 221/279 |
| 4,588,093 | A | 5/1986 | Field | 211/51 |
| 5,197,631 | A * | 3/1993 | Mishima | 221/52 |
| 5,388,693 | A * | 2/1995 | Ceraudo | 206/340 |
| 5,669,552 | A * | 9/1997 | Watanabe | 229/114 |
| 5,868,367 | A | 2/1999 | Smith | 248/174 |
| 6,082,558 | A | 7/2000 | Battaglia | 211/59.3 |
| 6,186,737 | B1 * | 2/2001 | Cohen | 414/800 |
| 6,454,107 | B1 | 9/2002 | Belanger et al. | 211/59.3 |
| 6,464,089 | B1 | 10/2002 | Rankin, VI | 211/59.3 |
| 6,550,636 | B2 * | 4/2003 | Simpson | 221/59 |
| 6,666,533 | B1 | 12/2003 | Stavros | 312/348.3 |
| 6,749,071 | B2 | 6/2004 | Caterinacci | 211/40 |
| 6,749,084 | B2 * | 6/2004 | Thompson | 221/56 |
| 6,772,888 | B2 | 8/2004 | Burke | 211/59.3 |
| 6,820,754 | B2 | 11/2004 | Ondrasik | 211/59.3 |
| 6,889,855 | B2 | 5/2005 | Nagel | 211/59.3 |

* cited by examiner

*Primary Examiner*—Darnell M Jayne
*Assistant Examiner*—Devin Barnett
(74) *Attorney, Agent, or Firm*—Keisling & Pieper PLC; David B. Pieper

(57) ABSTRACT

A compactable display is presented using a compactable pusher system constructed from folded sheet material using an elastic band as a biasing element. A unique polygon construction is described for generating increased tension on an elastic band as the polygon is compressed to generate forward biasing of objects in the compactable display. Construction and assembly of the unit is described with a two part construction that is held together by the elastic band using easily accessible connection points for quick assembly with additional access apertures provided for removal of the elastic band for easy disassembly of the display.

2 Claims, 3 Drawing Sheets

COMPACTABLE PRODUCT PUSHER SYSTEM AND DISPLAY

CROSS-REFERENCE TO RELATED APPLICATIONS

This application claims priority of U.S. Provisional Patent Application No. 60/764,100 filed on Jan. 31, 2006 entitled COMPACTABLE PRODUCT PUSHER SYSTEM AND DISPLAY, the whole of which is hereby incorporated by reference.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to the field of compactable displays. In particular, the present invention relates specifically to a pusher system using compactable components for shipping and easy assembly.

2. Description of the Known Art

As will be appreciated by those skilled in the art, corrugated displays and various types of pusher systems have been previously invented. Patents disclosing information relevant to various display systems include: U.S. Pat. No. 1,271,508, issued to Hall on Jul. 2, 1918; U.S. Pat. No. 2,538,165, issued to Randtke on Jun. 16, 1951; U.S. Pat. No. 3,166,195, issued to Taber on Jan. 19, 1965; U.S. Pat. No. 3,300,166, issued to Wojciechowski on Jan. 24, 1967; U.S. Pat. No. 3,433,546, issued to Cohen on Mar. 18, 1969; U.S. Pat. No. 4,588,093, issued to Field on May 13, 1986; U.S. Pat. No. 5,868,367, issued to Smith on Feb. 9, 1999; U.S. Pat. No. 6,082,558, issued to Battaglia on Jul. 4, 2000; U.S. Pat. No. 6,454,107, issued to Belanger et al. on Sep. 24, 2002; U.S. Pat. No. 6,464,089, issued to Rankin IV on Oct. 15, 2002; U.S. Pat. No. 6,666,533, issued to Stavros on Dec. 23, 2003; U.S. Pat. No. 6,749,071, issued to Caterinacci on Jun. 15, 2004; U.S. Pat. No. 6,772,888, issued to Burke on Aug. 10, 2004; U.S. Pat. No. 6,820,754, issued to Ondrasik on Nov. 23, 2004; and U.S. Pat. No. 6,889,855, issued to Nagel on May 10, 2005. Each of these patents are hereby expressly incorporated by reference in their entirety.

The most relevant information covered by these patents is identified as follows: U.S. Pat. No. 6,454,107, issued to Belanger, et al. on Sep. 24, 2002 is entitled Shipping and display container. The patent abstract notes that this invention teaches a tray-shaped shipping and display container has a support surface for supporting items for display. A pusher member is mounted for sliding movement on the support surface, and is elastically biased in a forward direction so that it continually urges items forward in the container to replace items removed from the front of the container by customers.

U.S. Pat. No. 5,868,367, issued to Smith on Feb. 9, 1999 is entitled Rapid-deployment display stand. Its abstracts describes its teaching as a display stand that includes a main body of a sleeve-shaped configuration including a first main portion, a second main portion, a pair of foldable side portions pivotably interconnecting the first and second main portions, a first auxiliary portion pivotably connected to the first main portion and extending across at least a part of the open upper end of the tubular formation in the erect condition, and a second auxiliary portion pivotably connecting the first auxiliary portion and depending down from the first auxiliary portion in the erect condition. At least one elastic element is connected to and extends between the lower end of the second main portion and the second auxiliary portion. This element acts directly on the second auxiliary portion and only through the same on the other portions.

U.S. Pat. No. 3,300,166, issued to Wojciechowski on Jan. 24, 1967 is entitled Collapsible automatically set display container. It is cited for the teachings of a rubber band biasing element.

U.S. Pat. No. 2,538,165, issued to Randtke on Jan. 16, 1951 is entitled Filing box and follower member. This patent is cited for its teachings of a pusher system using spring biased arms.

Thus, it may be seen that these prior art patents are very limited in their teaching and utilization, and an improved pusher system is needed to overcome these limitations.

SUMMARY OF THE INVENTION

The present invention is directed to an improved compactable display. In accordance with one exemplary embodiment of the present invention, a compactable display is provided using a compactable housing and a compactable pusher system constructed from folded cardboard sheet and rubber bands. Of particular note is the use of an elastic band to bias a collapsible hinged polygon to generate forward and backward motion. Unique connection apertures and removal access points are provided to allow for quick and efficient construction and tear down of the display.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
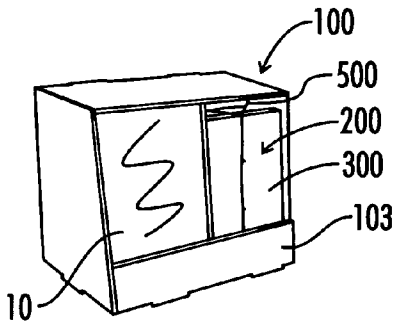
FIG. 1 is a perspective view of a display with a forward biased object on the left and exposed pusher system on the right.
Figure 2:
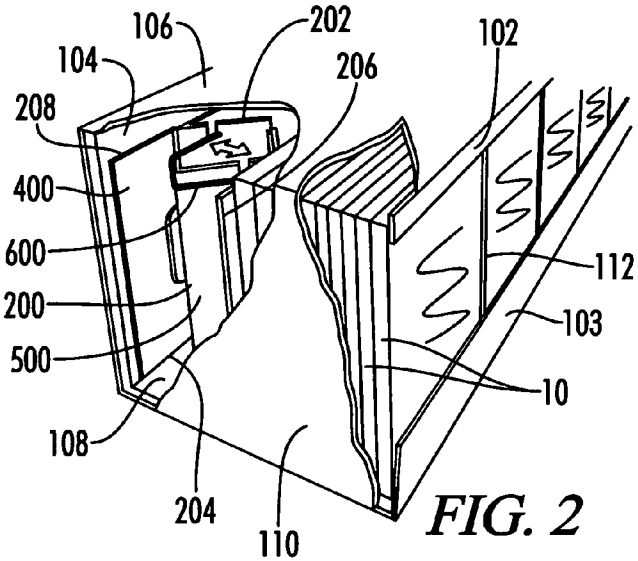
FIG. 2 is a cutaway view of the display showing the pusher system housed within the display cabinet.
Figure 3:
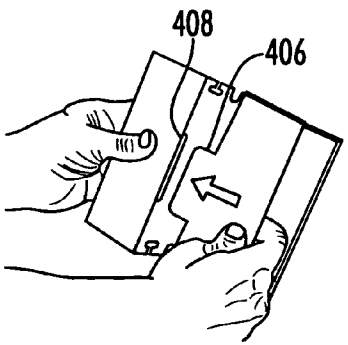
FIG. 3 is an assembly view showing how to assemble the tab to slot connection.
Figure 4:
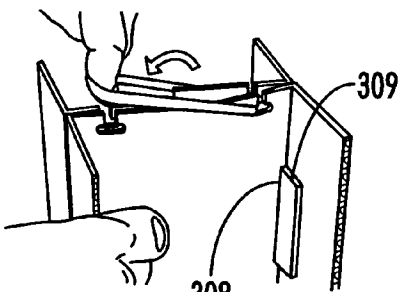
FIG. 4 is an assembly view showing how to assemble the elastic band onto the hinge frames of the pusher system.

As shown in FIGS. 1 and 2 of the drawings, one exemplary embodiment of the present invention is generally shown as a pusher display cabinet 100 using an internal pusher system 200 for moving and holding a series of objects 10 with the end object held at the front of the cabinet 100. In FIG. 1, the displayed object 10 is shown in the left portion of the cabinet and the exposed pusher system 200 is shown in the right portion of the cabinet. FIG. 2 shows a cabinet with the side cutaway to see the pusher system 200 working to bias the objects 10 forward. The Pusher system 200 includes a front distribution frame 300 and a back distribution frame 400 connected by a flexible polygon 500 using an elastic tension element 600 to bias the objects 10 toward the front display side of the cabinet 100.

As shown by FIGS. 1 and 2, the cabinet 100 is designed to aesthetically display the objects 10. The objects 10 are biased against either or both of the upper front catch 102 and lower front catch 103. As noted by the single use of the lower front catch 103 in FIG. 1 and the use of both the upper front catch 102 and the lower front catch 103 in FIG. 2, different constructions may eliminate or change aspects of the cabinet 100 while still retaining the functionality of the design. The cabinet 100 includes a back base wall 104 that provides a solid foundation for the pusher system 200. The pusher system 200 is guided in its operation by the top guide wall 106, bottom slide wall 108, left guide wall 110, and right guide wall 112. Note that a right guide wall 112 for the left most pusher system may also form the left guide wall 110 for the next pusher system 200 located in the adjacent bay of the cabinet. While the catches 102, 103, and walls 106, 108, 110, and 112 are generally shown as continuous solid walls or lips, other configurations which retain the holding and/or guiding function may be used to offer variations in the aesthetic appeal of the cabinet 100 without affecting the overall functioning of these components.

FIGS. 2 though 11 show the pusher system 200 and its components. The pusher system 200 provides the means to bias the objects 10 toward the front of the cabinet 100. In this description we have chosen a vertical orientation for the pusher system 200. The pusher system 200 has a basic top 202 and bottom 204 and a front pushing location 206 and back pushing location 208 which are biased away from each other. This biasing is done with the elastic construction of the pusher system 200 using a left expansion location 210 and right expansion location 212 which are biased toward each other by the elastic tension element 600.

Please note that the preferred embodiment of the pusher system 200 may be completely turned around or rotated horizontally in the cabinet without affecting its biasing operation. This description uses consistent wording based on the preferred embodiment as oriented in the display cabinets shown in FIGS. 1 and 2. Thus, the descriptive terms used herein to describe the top, bottom, left, right, front, and back is consistently used for remaining Figures in accordance with the orientation shown in FIGS. 1 and 2. For example, while the pusher system 200 has been rotated in FIG. 5 in relation to its orientation in FIGS. 1 and 2, the descriptive terms remain consistent with the orientation of FIGS. 1 and 2.

Returning to FIGS. 2 through 11, one may see that the front distribution frame 300 is located at the front pushing location 206. The front ends of the first folded sheet 501 and the second folded sheet 517 form the basic elements of the front distribution frame 300. The front distribution frame 300 is constructed from a front left pushing element 302 and a front right pushing element 304 which are connected together by insertion of the front left tab 306 into the front right slot 308. Similarly, the back distribution frame 400 is positioned at the back pushing location 208. The back distribution frame 400 is constructed from the back left pushing element 402 which is connected to the back right pushing element 404 by the insertion of the back left tab 406 into the back right slot 408. These distribution frames hold the front and back of the flexible polygon 500 in position so that the polygon 500 can bias the objects 10 forward.

Figure 6:
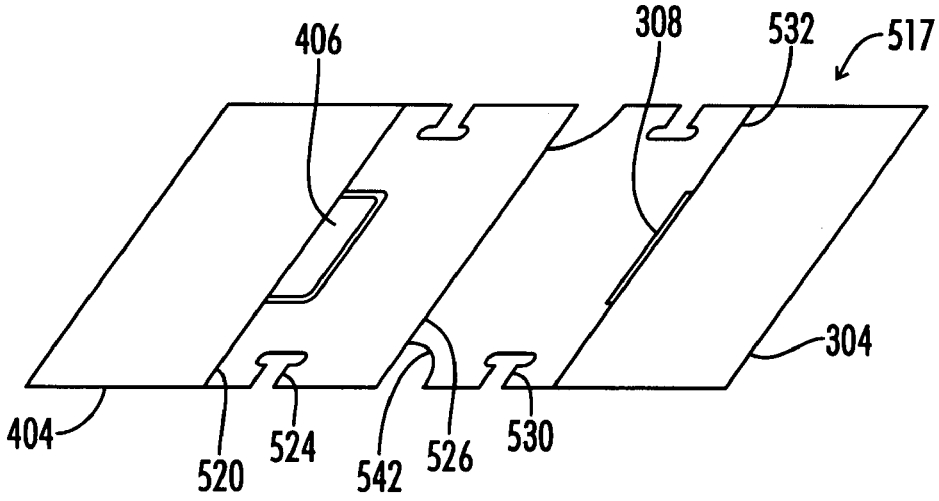
FIG. 6 is a perspective view of a sheet before folding.
Figure 7:
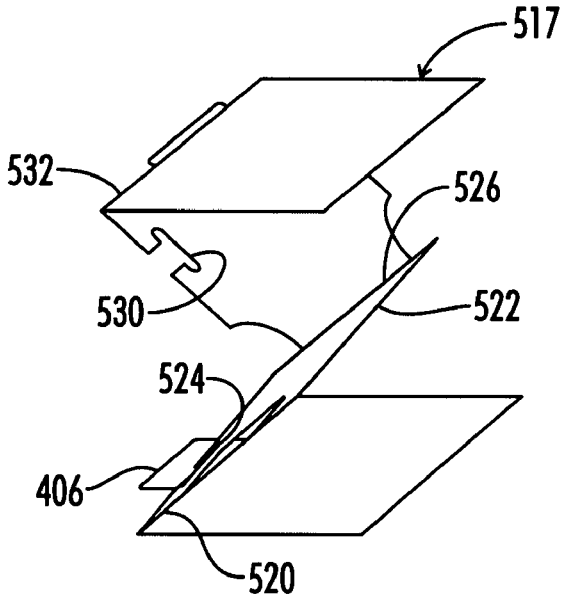
FIG. 7 is a perspective view of a folded sheet in a slightly compacted position.
Figure 8:
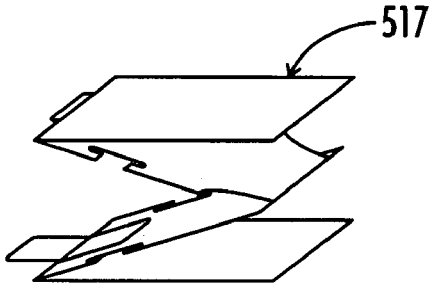
FIG. 8 is a perspective view of the folded sheet of FIG. 7 in a further compacted position.

Moving to FIGS. 6 through 11, one can see that the flexible polygon 500 is constructed from the hinges and middle sections of the first folded sheet 501 and the second folded sheet 517. FIG. 6 shows an unfolded sheet with the cutouts for the various connections and access apertures. FIG. 7 shows the sheet folded into a slightly compacted position and FIG. 8 shows a further compacted position.

Figure 9:
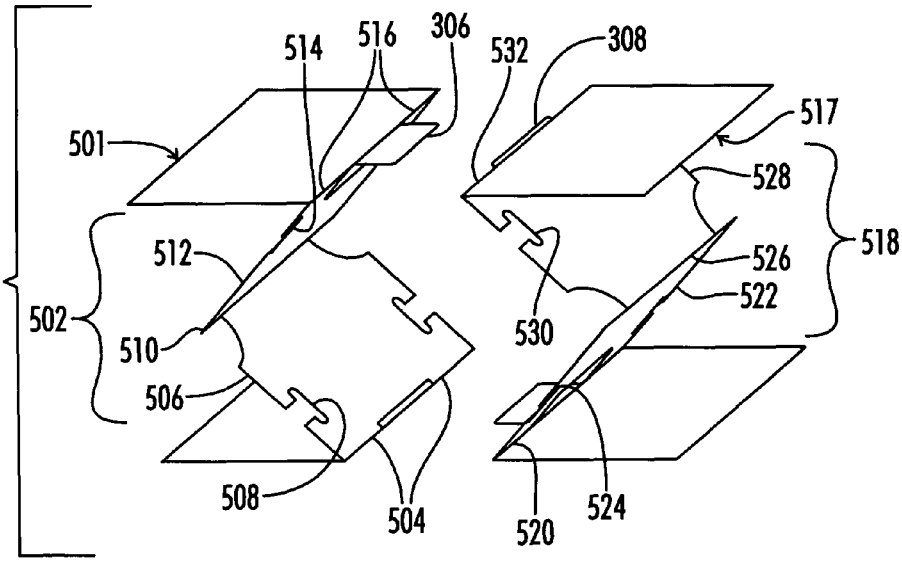
FIG. 9 is a perspective view of the two folded sheets that form the different sides of the pusher system.
Figure 10:
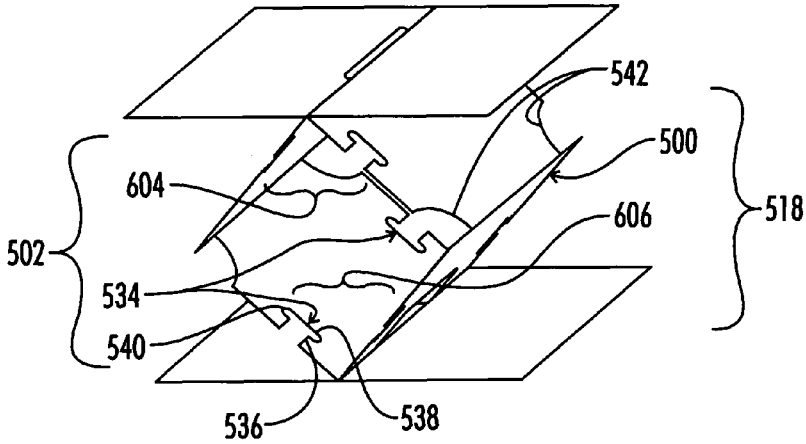
FIG. 10 is a perspective view of the two folded sheets in a partially compacted position with the tabs inserted into the slots.
Figure 11:
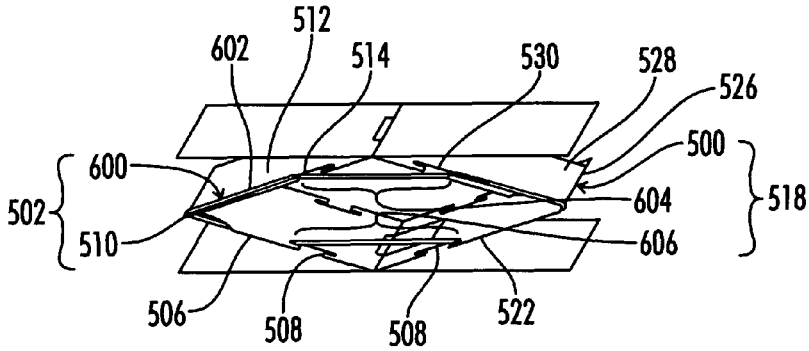
FIG. 11 is a perspective view of the folded sheets of FIG. 10 in a further compacted position.

FIGS. 9 through 11 show the first folded sheet 501 that forms the left hinged frame 502. The left hinged frame 502 includes the back left hinge 504 that connects through the back left rigid wall segment 506 to the center left hinge 510. The center left hinge 510 continues the connection forward through the front left rigid wall segment 512 to the front left hinge 516. The back left rigid wall segment 506 defines the back left catch 508 as a tensioner engagement aperture 534, and the front left rigid wall segment 512 defines the front left catch 514 as a tensioner engagement aperture 534. These catches 508, 514 provide for the connections to the tensioning device 600 shown in FIGS. 1 through 4. Note that a similar construction for the tensioner engagement apertures 534 is used on the other end of the first folded sheet 501 for a second tensioning element 600 as visible in FIG. 5. While a central aperture access point and single central tensioning element 600 has been considered, the two end mounted tensioning elements were selected for ease of assembly.

As shown by FIGS. 6 through 11, one may note a similar rotated construction for the second folded sheet 517 that forms the right hinged frame 518. The right hinged frame includes the back right hinge 520 that connects through the back right rigid wall segment 522 to the center right hinge 526. The connection then continues from the center right hinge 526 through the front right rigid wall segment 528 to the front right hinge 532. The back right rigid wall segment 522 defines the back right catch 524 as a tensioner engagement aperture 534, and the front right rigid wall segment 528 defines the front right catch 530 as a tensioner engagement aperture 534.

As labeled in FIG. 10, the tensioner engagement apertures 534 includes an edge access slot 536 opening to a retention recess 538 with a curved indented end 540. The indented ends 540 are curved in shape and include soft deformable edges such that they don't cut into the elastic tension element 600.

this shape also reduces force concentrations at these points on the cardboard used in the preferred embodiment.

Figure 5:
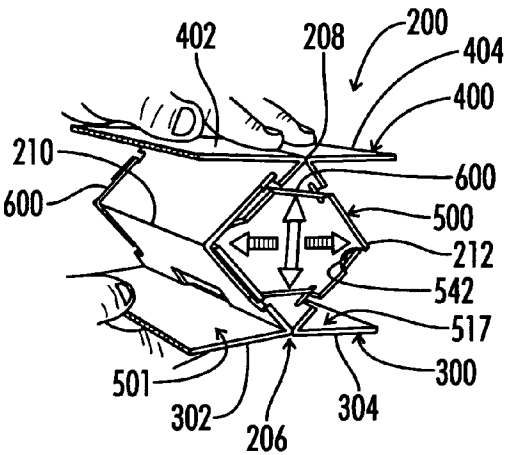
FIG. 5 is a perspective view showing the assembled pusher system in a partially compacted state.

As shown throughout the Figures and specifically labeled in FIGS. 5 and 10, tensioner removal apertures 542 are also provided as gaps in the walls so that a human finger can reach under the path of the rubber band 602 to grasp the elastic tension element 600 for disassembly or tear down of the pusher 200. This underside access to the elastic band 600 may be seen at the tensioner removal aperture 542 on the right side in FIG. 5.

As shown in FIGS. 1, 2, 4, 5, and as labeled in FIG. 11, the elastic tension element 600 is constructed from a rubber band 602 that passes from the back left catch 508 across the center part of the back left rigid wall segment 506 around the center left hinge 510 and then across the front left rigid wall segment 512 to the front left catch 514. The rubber band 602 is then stretched across the front separation gap 604 to the front right catch 530 and across the front right rigid wall segment 528 to the center right hinge 526. From the center right hinge 526 the rubber band 602 extends across a portion of the back right rigid wall segment 522 to the back right catch 524 where it cross the back separation gap 606 to reach the back left catch 508 to complete the loop. From this understanding of the rubber band 602 placement, the stretching of the rubber band across the gaps 604, 606 may be understood. It is this stretching of the rubber band 602 across the gaps that provides the biasing operation of the pusher system 200. From this operation, it may also be understood that any type of elastic element may be substituted for the rubber band. Alternative constructions may use metal or plastic springs, elastic straps, etc.

The increasing gap size and associated stretching of the rubber band may be understood by comparing the size of the gaps in FIGS. 10 and 11 associated with the different amounts of compression of the hinge frames 502, 518. As shown in FIG. 10, the gaps 604, 606 are of a first distance between the two hinge frames 502, 518. Compare the gaps of FIG. 10 with the gaps of FIG. 11. As shown in FIG. 11, when the hinge frames 502, 518 are compacted, the gaps 604, 606 are increased in distance. This increase in distance stretches the elastic tensioner 600 to bias the walls back together which results in the front of the pusher 200 being biased away from the back of the pusher 200. Also note how the tension provided by the tensioning element 600 works to hold the tab and slot connections together to maintain the integrity of the pusher system 200. This results in a stable construction for the pusher system 200. In this manner, a unique pusher has been constructed from compactable elements to reduce shipping volume while still providing an active pushing display system.

Reference numerals used throughout the detailed description and the drawings correspond to the following elements:

Display Cabinet 100
Object 10
Upper Front Catch 102
Lower Front Catch 103
Back Base wall 104
Top guide wall 106
Bottom slide wall 108
Left guide wall 110
Right guide wall 112
Pusher system 200
Top 202
Bottom 204
Front pushing location 206
Back pushing location 208
Left expansion location 210
Right expansion location 212
front distribution frame 300
Front left pushing element 302
Front right pushing element 304
Front left tab 306
Front right slot 308
back distribution frame 400
Back left pushing element 402
Back right pushing element 404
Back left tab 406
Back right slot 408
flexible polygon 500
First folded sheet 501
Left hinged frame 502
Back left hinge 504
Back left rigid wall segment 506
Back left catch 508
Center left hinge 510
Front left rigid wall segment 512
Front left catch 514
Front left hinge 516
Second folded sheet 517
Right hinged frame 518
Back right hinge 520
Back right rigid wall segment 522
Back right catch 524
Center right hinge 526
Front right rigid wall segment 528
Front right catch 530
Front right hinge 532
Tensioner Engagement apertures 534
Edge access slot 536
Retention recess 538
indented end 540
Tensioner removal aperture 542
Elastic tension element 600
Rubber band 602
Separation gap 604
Back separation gap 606

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically referring to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures.

What is claimed is:

1. A compactable display pusher apparatus for a display, the apparatus comprising:

a first sheet folded to define a first mid segment hingably connected at a first expansion location to a second mid segment, the first sheet defining at least one tensioner engagement aperture;

a second sheet folded to define a third mid segment hingably connected at a second expansion location to a fourth mid segment, the second expansion location distally positioned from the first expansion location, the second sheet also defining at least one tensioner engagement aperture;

at least one tensioning element connected between the tensioner engagement apertures; and the first sheet defining both a front pushing element hingably connected to the first mid segment and a back pushing element hingably connected to the second mid segment.

2. A compactable display pusher apparatus for a display, the apparatus comprising:

a first sheet folded to define a first mid segment hingably connected at a first expansion location to a second mid segment, the first sheet defining at least one tensioner engagement aperture;

a second sheet folded to define a third mid segment hingably connected at a second expansion location to a fourth mid segment, the second expansion location distally positioned from the first expansion location, the second sheet also defining at least one tensioner engagement aperture;

at least one tensioning element connected between the tensioner engagement apertures; the first sheet defining both a front pushing element hingably connected to the first mid segment and a back pushing element hingably connected to the second mid segment and the second sheet defining both a front pushing element hingably connected to the third mid segment and a back pushing element hingably connected to the fourth mid segment.

* * * * *